US005500494A

United States Patent [19]

Ligman

[11] Patent Number: 5,500,494

[45] Date of Patent: Mar. 19, 1996

[54] SYSTEM FOR MODIFYING OPERATION OF PNEUMATIC TOOL

[76] Inventor: Gary A. Ligman, 3914 Beechwood Dr., Concord, Calif. 94519

[21] Appl. No.: 421,090

[22] Filed: Apr. 13, 1995

Related U.S. Application Data

[63] Continuation-in-part of Ser. No. 201,214, Feb. 24, 1994, abandoned, which is a continuation of Ser. No. 20,120, Feb. 19, 1993, abandoned.

[51] Int. Cl.[6] ..... F01N 3/02

[52] U.S. Cl. ..... 181/230; 181/239; 181/268

[58] Field of Search ..... 181/230, 231, 181/238, 239, 241, 264, 268, 276–281; 55/276; 143/DIG. 2; 415/119

[56] References Cited

U.S. PATENT DOCUMENTS

| | | | |
|---|---|---|---|
| 1,115,704 | 11/1914 | Maines . | |
| 3,255,844 | 6/1966 | Wallace . | |
| 3,379,278 | 4/1968 | Skowron . | |
| 3,719,251 | 3/1973 | Hedrick . | |
| 3,970,168 | 7/1976 | Mucka | 181/230 |
| 3,993,159 | 11/1976 | Amador . | |
| 4,113,051 | 9/1978 | Moller | 181/231 |
| 4,119,174 | 10/1978 | Hoffman | 181/231 |
| 4,496,023 | 1/1985 | Lindberg et al. . | |
| 4,751,980 | 6/1988 | Devane | 181/239 |

FOREIGN PATENT DOCUMENTS

| | | | |
|---|---|---|---|
| 1372075 | 2/1988 | U.S.S.R. | 181/230 |

*Primary Examiner*—Khanh Dang
*Attorney, Agent, or Firm*—Thomas R. Lampe

[57] ABSTRACT

Apparatus for use in combination with a compressed air powered tool having an air exit port to modify the sound of the tool during operation. The apparatus includes a helical coil compression spring having a plenum and defining restricted, radially disposed flow paths communicating with the plenum. A spring support holds the spring in position on the tool and air passing from the air exit port of the tool enters the spring plenum and passes through the restricted, radially disposed flow paths. An adjustment mechanism moves the coil spring segments, varies the length of the spring, and varies the size of the restricted, radially disposed flow paths. The spring support prevents bending of the spring.

5 Claims, 6 Drawing Sheets

22A
24A
26A
60
60
60
60
1
2
3
4

20A
36A
22A
60
60
26A
22A
22A
22A
10
52
52
12

SYSTEM FOR MODIFYING OPERATION OF PNEUMATIC TOOL

This is a continuation-in-part application based on U.S. patent application Ser. No. 08/201,214, filed Feb. 24, 1994, now abandoned, which is a continuation of U.S. patent application Ser. No. 08/020,120, filed Feb. 19, 1993, now abandoned.

TECHNICAL FIELD

This invention relates to pneumatic tools, such as air ratchets, and more particularly, to a system for modifying at least one operational characteristic of the pneumatic tool. The invention encompasses both an apparatus and method. The system operates as a muffler for modifying the noise characteristics of air exhausted from the tool during operation thereof. The invention may also be utilized to control or vary the torque and speed of the pneumatic tool.

BACKGROUND ART

There are many arrangements in the prior art having the objective of redirecting the flow of exhaust from pneumatic tools to modify an operational characteristic thereof, such as noise. For example, U.S. Pat. No. 3,719,251, issued Mar. 6, 1973, relates to a diffuser apparatus for employment with a portable pneumatic tool such as a dentist drill to disperse exhausted air. The diffuser apparatus is formed as an integral unit of rigid material, such as metal or plastic, and incorporates an exhaust passageway formed into a plurality of spaced apart longitudinal passages. Each of the longitudinal passages are for communication with a plurality of spaced apart, annular transverse openings. The transverse openings, which are fixed in size and cannot be varied, connect the ambient atmosphere to the exhaust passageway.

U.S. Pat. No. 3,255,844, issued Jun. 14, 1966, discloses a multi-passage silencer for a pneumatic tool which consists of an assembly of thin rectangular plates stacked in uniformly spaced, fixed relation to each other. The air passing through the passageways defined by the plates to the ambient atmosphere allegedly reduces the noise of the exhaust gas.

U.S. Pat. No. 3,379,278, issued Apr. 23, 1968, discloses a muffler for use on a pneumatic tool such as a grinder. An open-ended sleeve of elastic, resilient material is tightly fitted over the body portion and exhaust ports of the tool, being bonded to the body portion. Spent air exhausted from the tool forces the sleeve away from the tool and escapes at the end of the sleeve.

U.S. Pat. No. 3,993,159, issued Nov. 23, 1976, discloses a muffler for reducing the noise level of the air exhaust from a governed pneumatic tool. The muffler, which is formed of plastic or metal, is secured to the tool housing by screws and forms an enclosed cavity extending about the exhaust apertures of the tool. A foraminous baffle plate, preferably a thin brass screen, is located within a cup-shaped body of the muffler.

U.S. Pat. No. 4,496,023, issued Jan. 29, 1985, discloses a plastic silencer surrounding a compressed air tool in the form of a pneumatically operated impact tool. The silencer forms an exhaust chamber around the tool. Two exhaust tubes project from the chamber and holes are drilled near the inlet ends of the tubes to prevent ice build-up.

U.S. Pat. No. 1,115,704, issued Nov. 3, 1914, discloses a pneumatic hammer muffler employing a leather sleeve or casing disposed about the tool. The casing is packed with a suitable fabric or waste to muffle the air as it exhausts.

My U.S. patent application Ser. No. 07/708,247, filed May 31, 1991, now U.S. Pat. No. 5,189,267, issued Feb. 23, 1993, relates to a muffler system for a pneumatic tool employing heat shrink tubing shrunk into position on the tool. Foraminous material is located between the tubing and tool in a restricted fluid-flow passageway extending between the tool air flow outlet and an end of the heat shrunk tubing.

DISCLOSURE OF INVENTION

In common with the with the arrangements shown in the above-identified patents, the present invention relates to apparatus for muffling air or other gases exhausted from equipment. The present invention is particularly adapted for use with a pneumatic tool and the apparatus disclosed herein is characterized by its relative simplicity and low cost.

The apparatus of the present invention has a degree of flexibility not found in the prior art. More particularly, the apparatus may be readily adjusted to modify the noise, torque, and/or speed of the pneumatic tool.

The apparatus can be retrofit to an existing tool or installed during manufacture of the tool. The apparatus is relatively compact and will not in any significant way hinder or impede normal pneumatic tool use.

The apparatus is for use with a pneumatic tool having an air exit port for the exit of compressed air after passage of the compressed air through the pneumatic tool.

The apparatus is for receiving the compressed air exiting from the exit port and redirecting the compressed air to modify at least one operational characteristic of the pneumatic tool.

The apparatus includes air flow restrictor means having an air inlet and a plurality of restrictor elements defining a plurality of substantially radially disposed, restricted air flow paths in fluid-flow communication with the air inlet. At least some of the plurality of restrictor elements are relatively movable to vary the sizes of at least some of the substantially radially disposed restricted air flow paths.

Attachments means is provided for attaching the air flow restrictor means to the pneumatic tool with the air inlet in fluid-flow communication with the pneumatic tool air exit port to redirect compressed air exiting from the pneumatic tool air exit port through the plurality of substantially radially disposed, restricted air flow paths.

Adjustment means is in operative association with the plurality of restrictor elements to relatively move at least some of the restrictor elements and vary the sizes of at least some of the substantially radially disposed, restricted air flow paths.

According to a preferred embodiment of the invention, the restrictor elements are discrete and have outer surfaces in at least partial registry with outer surfaces of adjacent restrictor elements to define the substantially radially disposed, restricted air flow paths.

In an alternative embodiment of the invention, the restrictor elements are integral with each other and are segments of a coil spring.

The invention also encompasses a method for modifying at least one operational characteristic of a pneumatic tool having an air exit port. The method includes the step of intercepting compressed air exiting the pneumatic tool exit port before the compressed air diffuses into the ambient atmosphere.

The intercepted compressed air is directed into a plenum and the compressed air is then broken into discrete portions of flowing compressed air.

Each of the discrete portions of flowing compressed air is passed through a substantially radially disposed, restricted flow path defined by relatively movable restrictor elements.

The discrete portions of flowing compressed air are separately diffused into the ambient atmosphere after passage thereof through the substantially radially disposed, restricted flow paths out of the plenum. The method may also encompass the step of varying the sizes of at least some of the substantially radially disposed, restricted flow paths.

Other features, advantages, and objects of the present invention will become apparent with reference to the following description and accompanying drawings.

MODES FOR CARRYING OUT THE INVENTION

Figure 1:
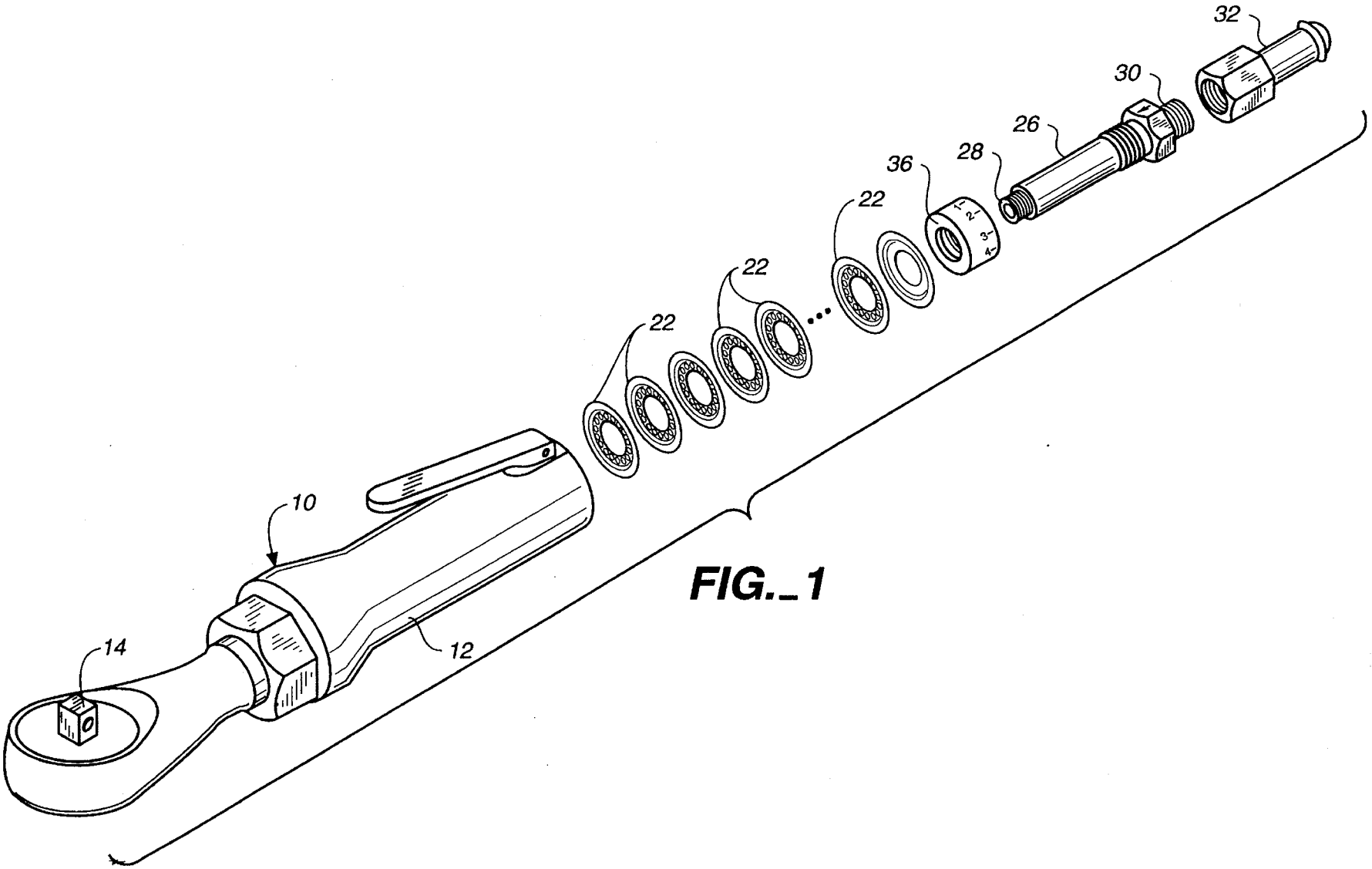
FIG. 1 is an exploded, perspective view illustrating components of an embodiment of the apparatus of the present invention prior to assembly of the apparatus on a pressurized air operated ratchet.
Figure 3:
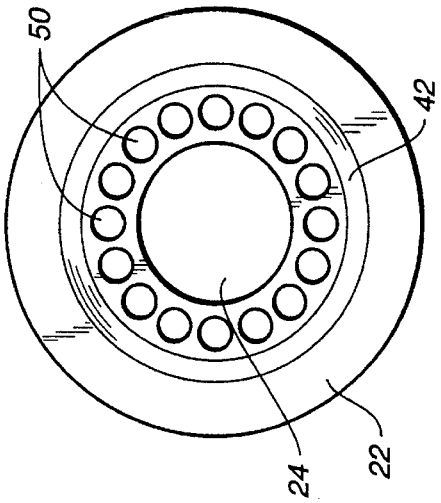
FIG. 3 is an enlarged, plan view of a restrictor element employed in the apparatus of FIG. 1.
Figure 1A:
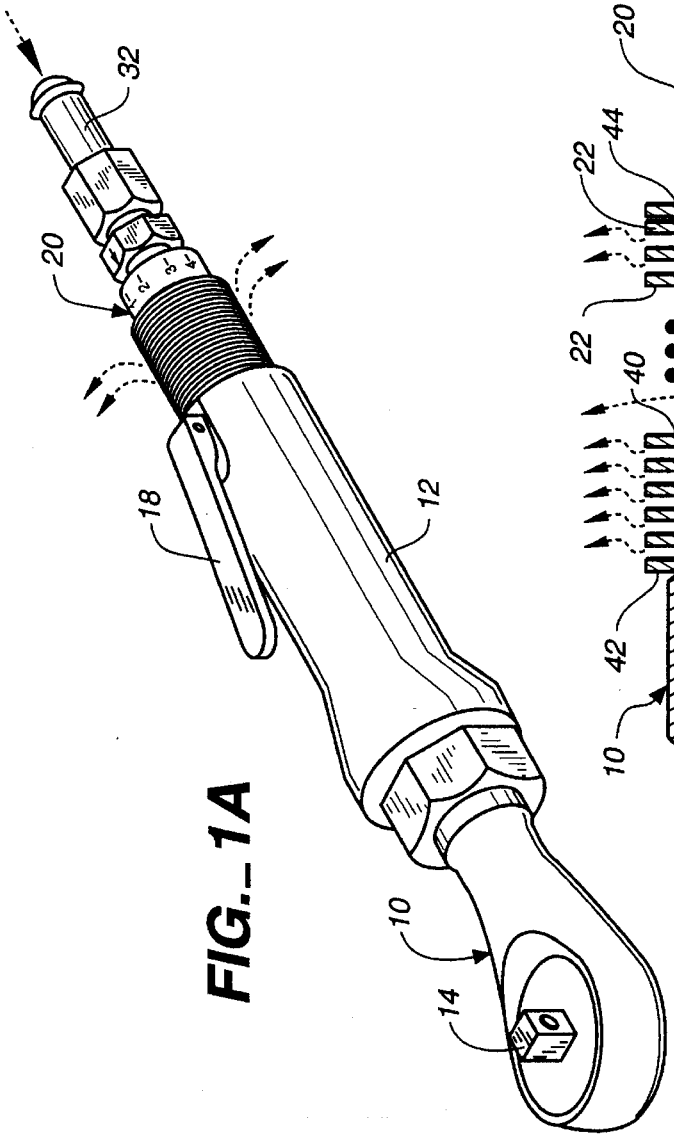
FIG. 1A is a perspective view illustrating the apparatus attached to the pressurized air operated ratchet.
Figure 2:
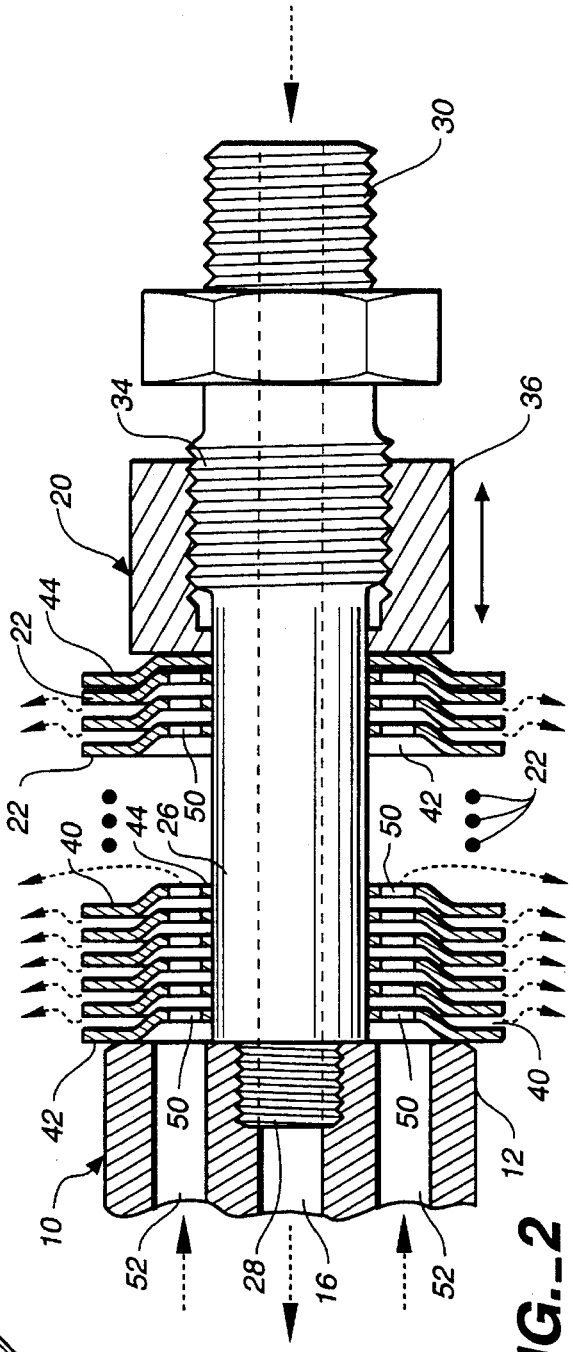
FIG. 2 is an enlarged, cross-sectional, somewhat schematic, side view illustrating operational components of the apparatus of FIG. 1 and the relative positions assumed thereby when attached to the end of a pressurized air operated ratchet.

Referring now to FIGS. 1 through 3, a pneumatic tool in the form of a pressurized air operated ratchet is designated by reference numeral 10. Ratchet 10 is of conventional construction and includes a body 12 and a rotatable tool element 14. Rotation of the tool element is effected by suitable conventional compressed air powered drive mechanism (not shown) disposed within the interior of the body 12.

Compressed air enters the end of the ratchet body removed from the tool element through a passageway 16 defined by the ratchet body at the center thereof (see FIG. 2). Compressed air entering the passageway 16 flows to the drive mechanism of the ratchet upon actuation by the operator of handle 18 in a conventional manner.

Apparatus constructed in accordance with the teachings of the present invention is designated by reference numeral 20. The apparatus includes a plurality of discrete restrictor elements 22, each of which has a centrally disposed throughbore 24. In the arrangement illustrated, restrictor elements 22 have an identical, substantially disk-like configuration. The restrictor elements are maintained in alignment and supported by a sleeve or tube 26. The sleeve 26 has threaded ends 28, 30.

Threaded end 28 matingly engages threads formed in the air supply end of the ratchet 10 to secure the apparatus in position with respect thereto. The interior of the sleeve 26 is in fluid-flow communication with passageway 16 of the ratchet whereby compressed air may be introduced into the ratchet through the apparatus 20. Threaded end 30 of the sleeve may be threadedly connected as shown to a conventional quick disconnect fitting 32 which, in turn, receives compressed air from a source thereof (not shown).

The throughbore 24 of each restrictor element is just large enough to accommodate sleeve 26 so that the restrictor element 22, unless otherwise restrained, can slide along the exterior of the sleeve 26. Any desired number of restrictor elements 22 may be employed and FIG. 2 depicts three of the restrictor elements schematically to represent that any desired number of restrictor elements may be deployed about sleeve 26.

The sleeve 26 includes threads 34 which are threadedly engaged by a knob or finger screw 36. Knob 36, which may have indicia thereon as shown, bears against an endmost restrictor element 22 having no apertures therein other than throughbore 24 and is used to move the restrictor elements relative to each other to vary the sizes of radially disposed, restricted air flow paths 40 defined by adjacent restrictor elements.

While having a generally disk-like configuration, restrictor elements 22 have opposed outer surfaces 42, 44 which are non-planar. The restrictor elements 22 nest or "cup" into one another as shown whereby the restricted flow paths 40 defined thereby have bends therein. That is, air flowing radially outwardly between the restrictor elements 22 does not flow directly at right angles, but rather makes two slight turns in the process. Such an arrangement deflects the exhausted air and has been found to particularly reduce the level of the higher pitched noise components thereof. However, noise suppression generally can be effected even when the restrictor element outer surfaces are planar.

A plurality of openings 50 are formed in each restrictor element 22. The openings 50 are arrayed in a circular configuration spaced from throughbore 24. As can be seen with particular reference to FIG. 2, the openings 50 are in communication with each other, essentially forming a plenum, and also with the air flow paths 40 defined by the restrictor elements.

The ratchet 10 illustrated has two air exit ports 52 through which pressurized air exits the ratchet after powering the ratchet drive mechanism. The air passes through the openings 50 of the restrictor elements and flows radially outwardly as shown by the arrows through the air flow paths 40.

The knob 36 can either enlarge or narrow the air flow paths depending upon whether the knob is moved toward the restrictor elements 22 or away therefrom. Relative movement between the restrictor elements 22 will modify the sound or noise produced by the vented pressurized air and the operator can adjust the apparatus by ear to provide the most desirable effect with regard to noise suppression.

Tightening of the restrictor elements 22 relative to each other also has the effect of controlling the flow of air through the ratchet. In other words, by narrowing the air flow paths 40 total air flow from the ratchet can be controlled. At the extreme, the restrictor elements 22 can be tightened to such an extent that virtually no air will flow therebetween. This latter condition will, of course, stop movement of the ratchet altogether. As the knob or nut 36 is loosened, rotational speed and torque of tool element 14 will gradually increase, with maximum rotational speed and torque occurring when compressed air flows relatively freely between the restrictor elements 22.

Figures 4, 5, 6:
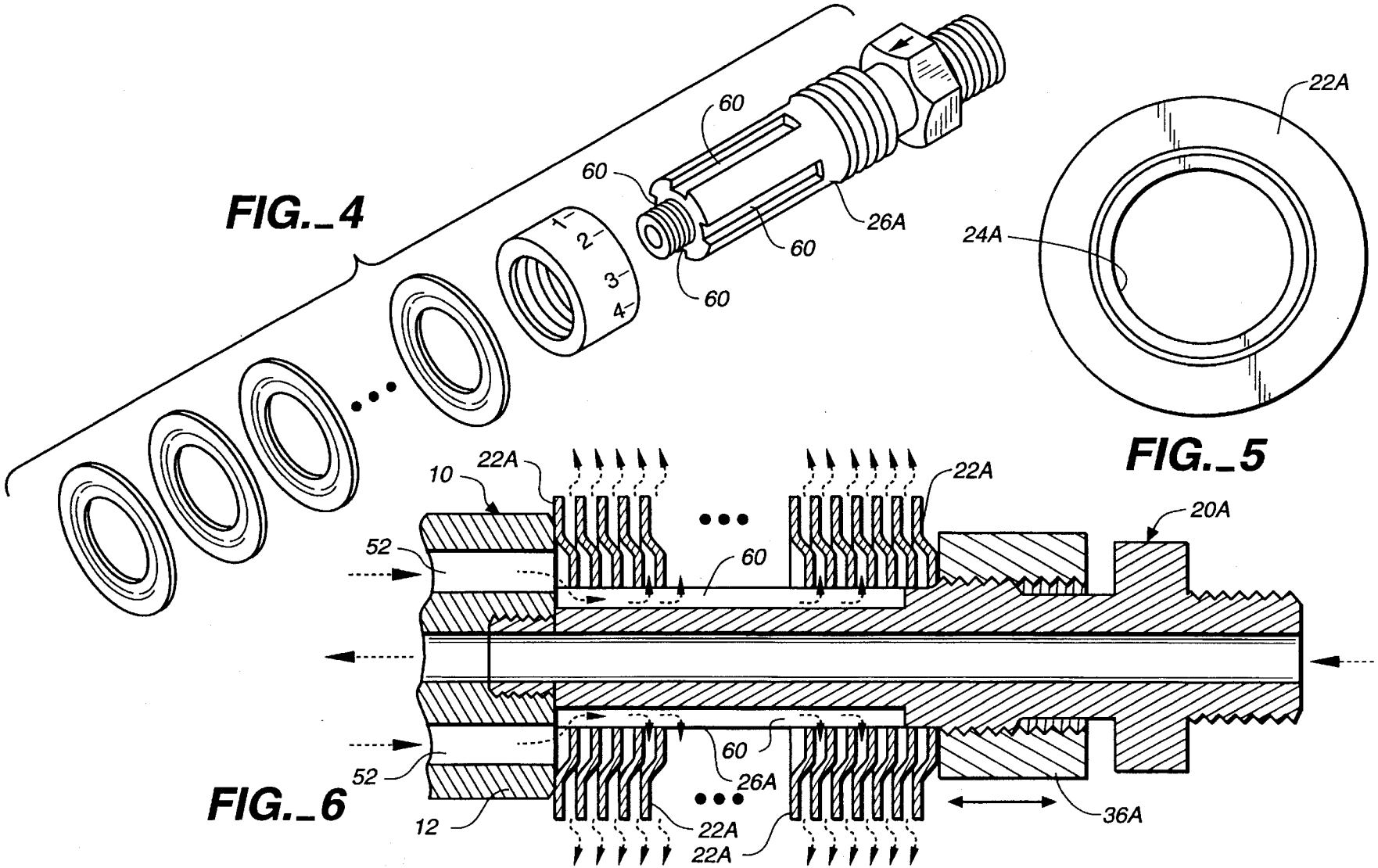
FIG. 4 is an exploded, perspective view illustrating an alternative form of the apparatus.
FIG. 5 is an enlarged, plan view of a restrictor element of the type employed in the alternative form of apparatus shown in FIG. 4.
FIG. 6 is a view similar to FIG. 2, but illustrating the alternative form of apparatus attached to a pressurized air operated tool.

Referring now to FIGS. 4–6, inclusive, an alternative embodiment of apparatus constructed in accordance with the teachings of the present invention is illustrated. The apparatus 20A differs in several significant respects from that described above. In particular, the restrictor elements 22A do not have openings therein corresponding to openings 50 of the first embodiment of the invention as described above. Instead, air exiting the exit ports 52 of ratchet 10 passes into grooves or channels 60 formed in sleeve 26A. The grooves 60 act in the nature of a plenum to distribute the pressurized exhaust air to the substantially radially disposed, restricted air flow paths defined by restrictor elements 22A. Again, relative movement between restrictor elements 22A and relative to the sleeve 26A may be effected by rotating threaded nut or knob 36A.

Figure 7:
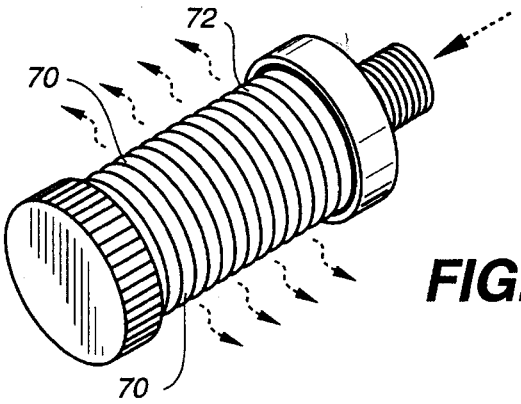
FIG. 7 is a perspective view of another alternative form of apparatus constructed in accordance with the teachings of the present invention.
Figure 8:
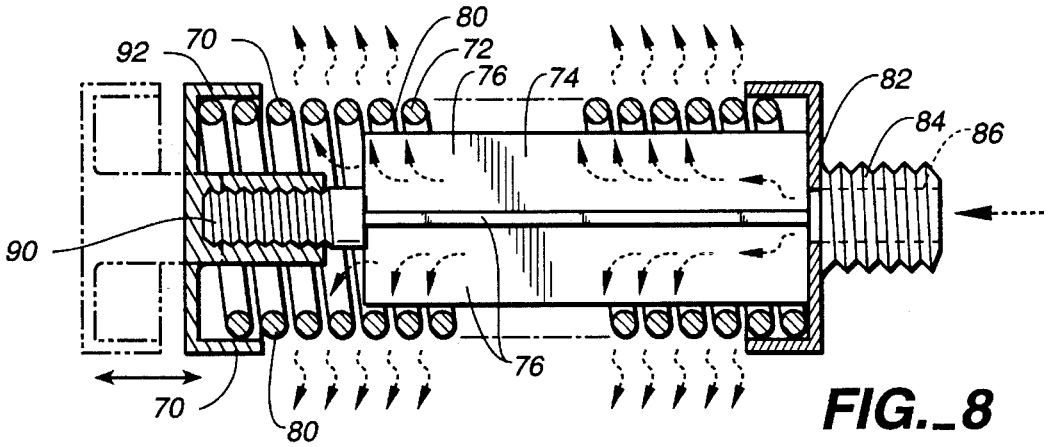
FIG. 8 is an enlarged, cross-sectional view of the form of apparatus shown in FIG. 7.

Yet another embodiment of apparatus constructed in accordance with the teachings of the present invention is illustrated in FIGS. 7–8. In this arrangement the restrictor elements each comprise a loop or segment 70 of a helical coil spring 72. Coil spring 72 is disposed about a support member 74 having four support panels 76 secured together and defining a generally cruciform-shaped cross section. The support panels 76 are disposed within the coil spring 72, the coil spring segments normally being spaced from one another to define a plurality of substantially radially disposed, restricted air flow paths 80 or passageways communicating with the plenum defined by the spring interior.

Affixed to the support panels at an end of the support member is a cup-shaped receptacle 82 which receives one end of the coil spring 72. A threaded boss 84 projects from the receptacle 82 and defines a throughbore 86. It is to be understood that the throughbore 86 is to be placed in communication with one or more air exit ports of a ratchet or other air powered tool, the threads of boss 84 being employed to secure the apparatus to the tool.

The pressurized air exhausted from the ratchet or other tool will enter the spaces between support panels 76 as shown by the arrows in FIG. 8. The spring and support member thus form plenum chambers to distribute the compressed air to the air flow paths 80. That is, the compressed air from the ratchet or other tool is broken into discrete portions of flowing compressed air which pass through the substantially radially disposed, restricted flow paths defined by the coil spring segments 70.

A threaded stub shaft 90 projects from the support member 74 at the end thereof remote from threaded boss 84. A knob 92 is threadedly engaged with the threaded stub shaft 90, rotation of the knob by the operator being utilized to compress the spring to narrow or constrict the passageways 80 to control operation of the apparatus.

Figure 7A:
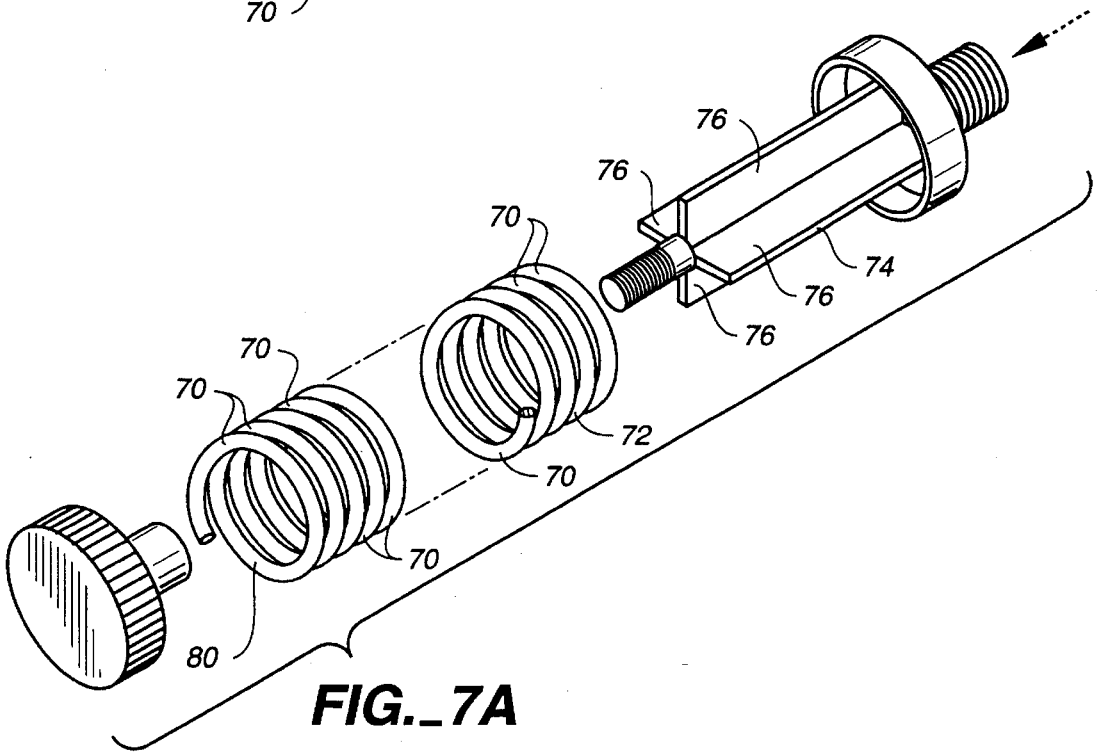
FIG. 7A is an exploded, perspective view illustrating components of the form of apparatus shown in FIG. 7.
Figure 9:
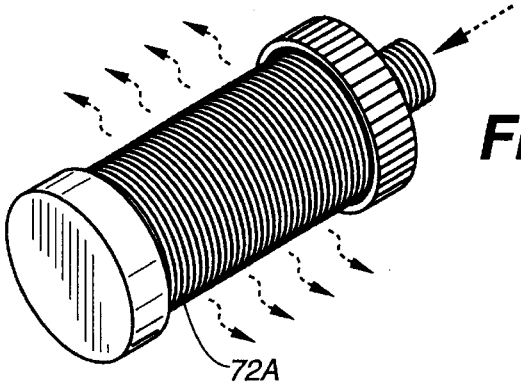
FIG. 9 is a view similar to FIG. 7, but illustrating another variation of the apparatus.
Figure 9A:
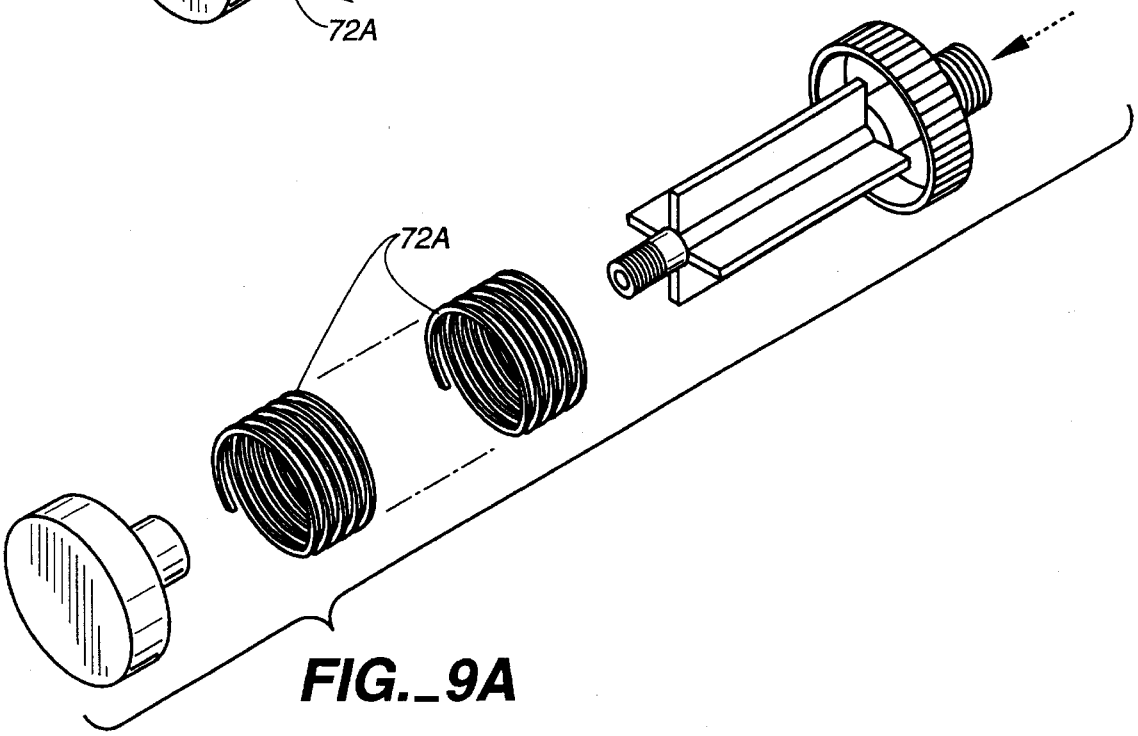
FIG. 9A is a view similar to FIG. 7A, but illustrating the form of apparatus shown in FIG. 9.

The form of apparatus shown in FIGS. 9, and 9A is essentially the same as that shown in FIGS. 7, 7A and 8, except that spring 72A is formed of coils which have a rectangular, rather than round, cross-section.

Figure 10:
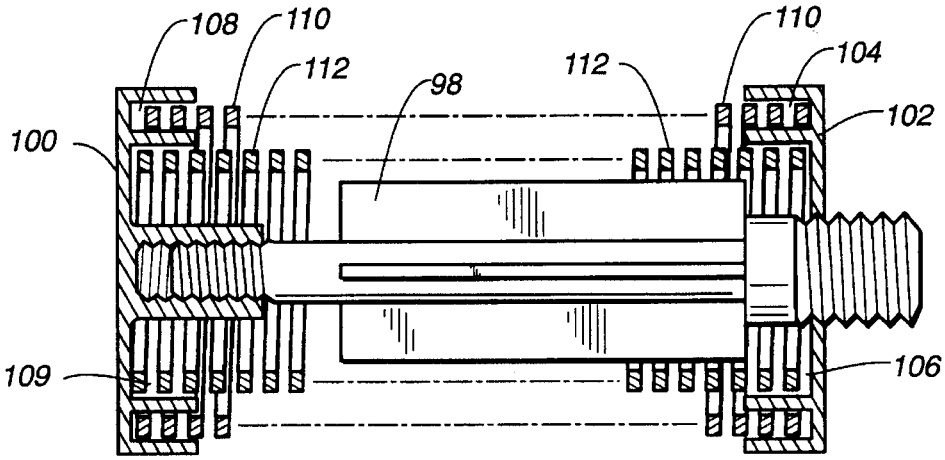
FIG. 10 is a view similar to FIG. 8, but of yet another alternative form of the apparatus.

FIG. 10 illustrates a form of the apparatus wherein a support member 98 has cup-like receptacles 100 and 102 connected thereto. Receptacle 102 defines an outer circular recess 104 and an inner circular recess 106. Receptacle 100 has an outer circular recess 108 and an inner circular recess 109. An outer coil spring 110 is located in the outer recesses and an inner coil spring 112 is located in the inner recesses. Thus, exhaust air must pass through both coil springs when being exhausted.

Figure 11:
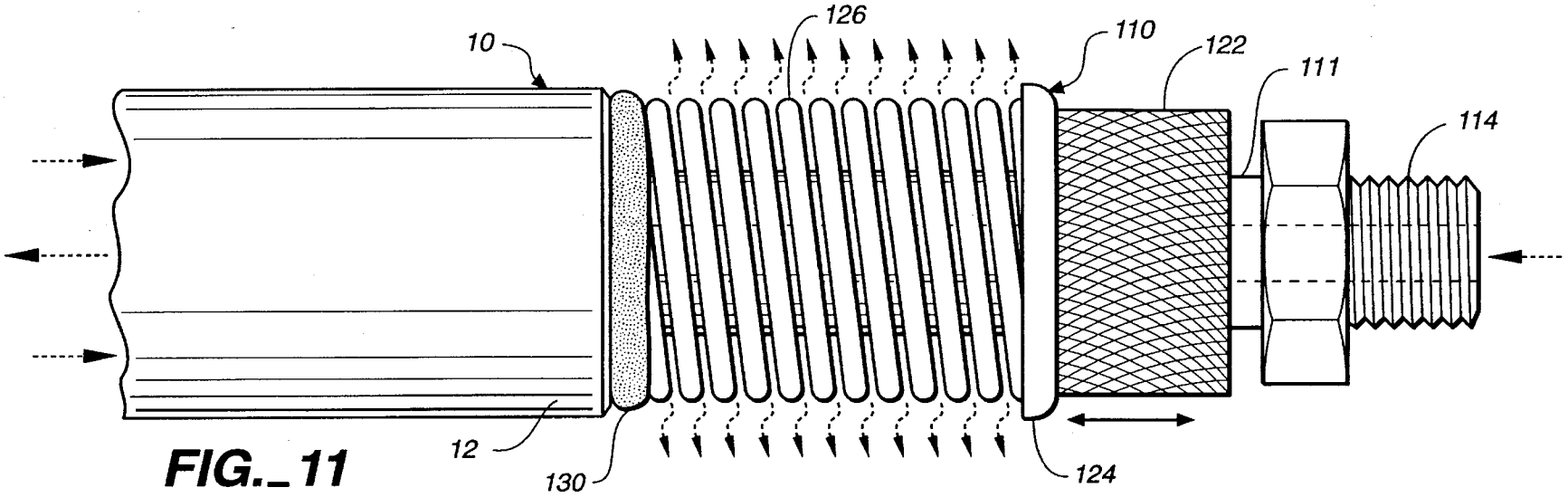
FIG. 11 is a side view of still another alternative embodiment of the apparatus connected to the end of a pressurized air operated ratchet.
Figure 12:
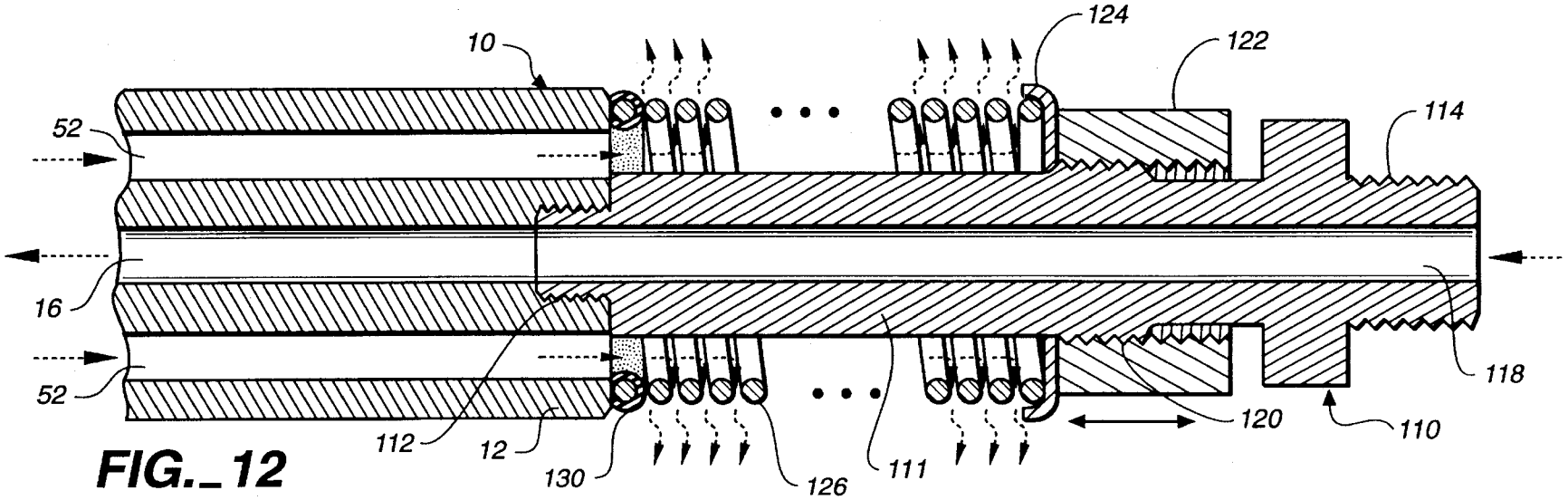
FIG. 12 is a cross-sectional view of the FIG. 11 embodiment of the apparatus and associated pressurized air operated ratchet.

Referring now to FIGS. 11 and 12, another embodiment 110 of the invention is shown connected to a ratchet 10 having a compressed air entry passageway 16 and exit ports 52.

Apparatus 110 includes a sleeve or tube 111 having threaded bosses 112, 114 at the ends thereof. One of these threaded bosses, boss 112, is threadedly engaged with the ratchet as shown in FIG. 12. The other end of the sleeve 111 is connected by boss 114 to an air hose (not shown). A suitable quick disconnect (also not shown) of conventional nature may be utilized to interconnect the tube and air hose. Compressed air from the air hose will enter the throughbore 118 of the tube and enter air inlet passageway 16 of the ratchet 10 as shown by arrows in FIG. 12.

Screw threads 120 are formed on sleeve 111 at a location between the threaded bosses. Threadedly engaged with screw threads 120 is a knurled nut 122 which may be moved axially relative to the sleeve upon rotation by the operator. Connected to nut 122 is a curved plate 124 of dish-like configuration defining a concave surface oriented toward ratchet 10. Together nut 122 and concave plate 124 define a receptacle adjustable relative to the sleeve 111 and ratchet 10 for receiving an end of a helical coil compression spring 126.

Spring 126 has an interior forming a plenum and is comprised of a plurality of integral, axially aligned coil spring segments normally spaced from one another to define a plurality of radially disposed, restricted flow paths communicating with the plenum.

One end of the coil compression spring is seated against plate 124 while the other end thereof is seated against the end of ratchet 10. Thus, movement of the nut and plate toward the ratchet will compress the spring and diminish the size of the radially disposed restricted flow paths.

Air exiting the exit ports 52 of ratchet 10 enters the plenum defined by the spring 126, the end of the spring bearing against ratchet 10 doing so outwardly away from the locations of the air exit ports.

As shown, the coil spring segment at the spring end bearing against the ratchet is coated with plastic or the like to form a seal 130. Since the seal extends all the way around the ratchet end, air exiting the ratchet must pass into the plenum or interior of the spring and exit between the coils. The operator readily can adjust the degree of compression of the spring 126 to control air flow between the coil spring segments and thus vary the sound characteristics thereof by turning nut 122.

The combination of the sleeve or tube 111, nut 122 and plate 124 thus form a spring support for the helical coil compression spring which is under continuous compression. The rigid sleeve or tube 111 cooperates with the helical coil compression spring to prevent bending thereof and to maintain the coil spring elements in axial alignment.

Movement of the plate 124 and nut 122 relative to the sleeve will simultaneously move the spring segments, vary the length of the helical coil compression spring, and vary the size of the restricted flow paths.

I claim:

1. Apparatus for use in combination with a compressed air powered tool having an air exit port to modify the sound of the compressed air powered tool during operation of the compressed air powered tool, said apparatus comprising, in combination:

a helical coil compression spring defining a plenum and comprised of a plurality of integral, axially aligned coil spring segments normally spaced from one another to define a plurality of radially disposed, restricted flow paths in fluid-flow communication with said plenum, said helical coil compression spring having spaced spring ends; and a spring support for the helical coil compression spring extending through the interior of said helical coil compression spring and projecting from the spring ends, said spring support including spring support ends spaced from one another and a spring engaging surface in continuous engagement with and continuously bearing against a spring end of said helical coil compression spring exerting compressive forces on said helical coil compression spring to continuously maintain said helical coil compression spring under compression, one of said spring support ends for connecting the helical coil compression spring to a compressed air powered tool with the plenum of the helical coil compression spring in communication with an air exit port of the compressed air powered tool, said spring support additionally including a rigid support segment within the plenum of the helical coil compression spring adjacent to said coil spring segments and cooperable with said helical coil compression spring to prevent bending of the helical coil compression spring and maintain the coil spring segments in axial alignment, and adjustment means for moving said spring engaging surface relative to said rigid support segment to simultaneously move said coil spring segments, vary the length of said helical coil compression spring, and vary the size of said restricted flow paths.

2. The apparatus according to claim 1 wherein said spring support includes a receptacle for receiving an end of the helical coil compression spring, said receptacle being selectively moveable relative to said rigid support segment to simultaneously move said coil spring segments, vary the length of said helical coil compression spring, and vary the size of said restricted flow paths.

3. The apparatus according to claim 1 wherein said rigid support segment defines a fluid-flow passageway for delivering compressed air to a compressed air powered tool.

4. The apparatus according to claim 1 additionally comprising a seal for placement between one of said spring ends and a compressed air powered tool.

5. The apparatus according to claim 4 wherein said seal comprises a seal coating about a coil spring segment at a spring end.

* * * * *